US006486615B2

(12) United States Patent
Hui et al.

(10) Patent No.: US 6,486,615 B2
(45) **Date of Patent: *Nov. 26, 2002**

(54) DIMMING CONTROL OF ELECTRONIC BALLASTS

(75) Inventors: Shu-Yuen Ron Hui, Hong Kong (HK); Shu-Hung Henry Chung, Hong Kong (HK)

(73) Assignee: City University of Hong Kong, Kowloon (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,512

(22) Filed: Oct. 13, 1998

(65) Prior Publication Data

US 2002/0014861 A1 Feb. 7, 2002

(51) Int. Cl.[7] ..... H05B 41/36
(52) U.S. Cl. ..... 315/291; 315/209 R
(58) Field of Search ..... 315/291, 209 R, 315/294, 224, 307, 194, 324, 293, 313, 312, 308, 299; H05B 41/36

(56) References Cited

U.S. PATENT DOCUMENTS

| | | | | | |
|---|---|---|---|---|---|
| 5,187,414 | A | * | 2/1993 | Fellows et al. | 315/307 |
| 5,214,356 | A | * | 5/1993 | Nilssen | 315/224 |
| 5,289,083 | A | | 2/1994 | Quazi | 315/224 |
| 5,434,481 | A | * | 7/1995 | Nilssen | 315/247 |
| 5,488,269 | A | | 1/1996 | El-Hamamsy et al. | 315/307 |
| 5,621,279 | A | * | 4/1997 | Nilssen | 315/247 |
| 5,856,919 | A | * | 1/1999 | Moriarty, Jr. | 363/101 |
| 5,874,809 | A | * | 2/1999 | Hagen | 315/224 |
| 5,923,128 | A | * | 7/1999 | Canova | 315/291 |
| 6,034,489 | A | * | 3/2000 | Weng | 315/307 |
| 6,072,284 | A | * | 6/2000 | Lin | 315/307 |
| 6,111,359 | A | * | 8/2000 | Work et al. | 315/56 |

FOREIGN PATENT DOCUMENTS

WO WO 00/48433 8/2000

OTHER PUBLICATIONS

1995, "Dimmable Cold–Cathode Fluorescent Lamp Ballast Design Using the UC3871"; J. O'Connor et al.; abstract.

Hisao Kobayashi, et al.; "Energy–Saving Lighting Control System, MESL–D Series"; *Toshiba Review;* Jan.–Feb. 1982; No. 137, pp. 27–31.

Rudolph R. Verderber, et al.; "Performance of electronic Ballast and Controls With 34– and 40–Watt F40 Fluorescent Lamps"; *IEEE Transactions on Industry Applications;* Nov./Dec. 1989; vol. 25, No. 6, pp. 1049–1059.

Nanjou Aoike, et al.; "Electronic ballast for fluorescent lamp lighting system of 100 lm/W overall efficiency"; *Journal of IES;* Oct. 1984; pp. 225–239.

M.I. Mahmoud, et al.; "Design Parameters for High Frequency Series Resonance Energy Converters used as Fluorescent Lamp Electronic Ballast"; *EPE Aachen;* 1989; pp. 367–371.

(List continued on next page.)

*Primary Examiner*—Don Wong
*Assistant Examiner*—Trinh Vo Dinh
(74) *Attorney, Agent, or Firm*—Merchant & Gould P.C.

(57) ABSTRACT

The invention provides an apparatus and a method for controlling the power output of a fluorescent lamp in order to provide dimming control. The fluorescent lamp is driven by an electronic ballast, for example a half-bridge resonant inverter, and the electronic ballast is switched at a constant frequency and with a constant duty-cycle, but with a variable DC voltage power input. Dimming control is provided by variation of the DC voltage power supply. The variable DC supply may be obtained from an AC source followed by a power factor corrected AC-DC variable converter, or a DC source followed by a variable DC—DC converter.

12 Claims, 8 Drawing Sheets

OTHER PUBLICATIONS

P. Zhu, et al.; "Modelling of a high–frequency operated fluorescent lamp in an electronic ballast environment"; *IEE Proc.—Sci. Meas. Technol.;* May 1998; vol. 145, No. 3, pp. 111–116.

ML4833, "Electronic Dimming Ballast Controller"; *Micro Linear;* Apr. 1997; pp. 1–16.

Marian K. Kazimierczuk, et al.; "Electronic Ballast for Fluorescent Lamps"; *IEEE Transactions on Power Electronics;* Oct. 1993; vol. 8, No. 4, pp. 386–395.

G. Gambirasio, et al.; "High Frequency Power Converters for Fluorescent Lamps"; *EPE Aachen;* 1989; pp. 337–339.

Louis r. Nerone; "A Mathematical Model of the Class D Converter for Compact Fluorescent Ballasts"; *IEEE Transactions on Power Electronics;* Nov. 1995; vol. 10, No. 6, pp. 708–715.

K.H. Jee, et al.; "High Frequency Resonant Inverter for Group Dimming Control of Fluorescent Lamp Lighting Systems"; pp. 149–154.

* cited by examiner

DIMMING CONTROL OF ELECTRONIC BALLASTS

FIELD OF THE INVENTION

This invention relates to an apparatus and method for the dimming control of an electronic ballast for a fluorescent lamp. In particular the invention relates to an apparatus and method for such dimming control that generates low electromagnetic interference and low switching stress.

BACKGROUND OF THE INVENTION

Electronic ballasts for the high-frequency operation of fluorescent lamps have been increasingly adopted as an energy efficient solution in residential, commercial and industrial lighting applications. Electronic ballasts have a number of advantages including improved efficiency of the overall system, higher lumen output per watt and longer lifetime of the fluorescent lamps. Electronic ballasts are in effect switched mode power electronic circuits, and most modem electronic ballast designs employ series resonant converters as the power circuits for driving the lamps.

PRIOR ART

FIG. 1 shows a conventional electronic ballast design. The basic concept of this design is to use the resonant voltage across the resonant capacitor $C_r$ to cause the lamp arc to strike at high frequency, typically from 25 kHz to 50 kHz. Because of the high frequency of the excitation voltage the lamp is essentially in a continuous on-state, which provides high-quality illumination without any unwanted flickering effect.

FIG. 2 shows a conventional implementation of a half-bridge series resonant inverter for an electronic ballast application. In this arrangement the two switches S1 and S2 are complementary switches (ie when S1 is on S2 is off, and vice versa). If the potential at point Y is taken as the zero voltage reference point, then voltage $V_{xy}$ will have the values $\pm V_{dc}/2$ where $V_{dc}$ is the DC voltage applied to the ballast circuit either by an AC-DC converter if the power source is AC or by a DC—DC converter if the power source is DC. The operation of this conventional circuit will now be described for the purposes of illustration.

The two capacitors C are much larger than the resonant capacitor $C_r$ and provide a stable DC voltage nominally at $V_{dc}/2$ at the point Y. By operating the switching frequency $f_{sw}$ of S1 and S2 slightly higher than the resonant frequency $f_r$ of inductor $L_r$ and capacitor $C_r$ the resonant load becomes inductive. If the current ($i_{Lr}$) in the inductor $L_r$ is continuous, S1 and S2 can be turned on under zero-voltage. This zero-voltage switching is desirable because it reduces turn-on switching loss and minimises the electromagnetic interference (EMI) from the power switches. If additional small capacitors Cs1 and Cs2 are added as shown in FIG. 2, switches S1 and S2 can also be turned off under zero-voltage as long as the inductor current ($i_{Lr}$) is continuous.

Series resonant converter designs such as that shown in FIG. 2 are very popular. One reason for this popularity, for example, is that a circuit of this design can be used for a multiple lamp system simply by connecting several sets of resonant tanks and lamps across points X and Y. This flexibility greatly reduces the ballast cost per lamp.

Difficulties arise with the circuit of FIG. 2, however, when it is desired to provide a method of dimming control. Most electronic ballasts employ a nominally constant converter DC voltage and in order to control the light intensity of the fluorescent lamp dimming control is provided. Two methods of providing dimming control are commonly used in this type of ballast arrangement: duty cycle control and variation of switching frequency and these will now both be described.

The first method of dimming control is by control of the duty cycle (d) of the two switches S1 and S2. The ideal duty cycle is 0.5 but in practice the maximum d should be slightly less than 0.5 so that a small deadtime when both switches are off is provided to avoid shoot-through in S1 and S2. FIG. 3 shows typical waveforms of the gating signals of S1 and S2. By controlling the turn-on and turn-off times of the two switches the voltage applied to the series resonant circuit can be controlled. This method is not without its drawbacks however, especially at low duty-cycles, ie at low applied voltage, as will be seen from the following.

A major advantage of the circuit of FIG. 2 is that the switches can be turned on and off under zero-voltage conditions which substantially reduces EMI emission and switching stress in the power switches. However as will be seen below, if the duty cycle is too small the inductor current may become discontinuous and the zero-voltage switching conditions will be lost and the switches will suffer switching stress, leading to reduced reliability and increased EMI emission. This can be seen from the following explanation of the operating modes of the power converter which are described with reference to FIG. 4 of the accompanying drawings which schematically highlight the main current paths.

FIG. 4(*a*) shows a first stage in which switch S1 is ON while switch S2 is OFF and the main current path is highlighted in bold. In a second stage shown in FIG. 4(*b*) the two switches are OFF while Cs1 is charged up to $V_{DC}$ and Cs2 is discharged. When Cs2 is discharged the anti-parallel diode of S2 will start to conduct. Again the main current path is highlighted in bold. FIG. 4(*c*) shows this third stage in which the two switches S1 and S2 are both still OFF and the anti-parallel diode is conducting clamping the voltage across S2 to almost 0V and when the switch S2 is later turned on again it is turned on under this zero-voltage condition. However, this assumes that the inductor current is continuous. If the duty cycle is too small the inductor current may decay to zero before the switch S2 is turned on again giving the condition shown in FIG. 4(*d*). If the inductor current falls to zero before S2 is switched on again, the voltage across S2 is not clamped to near zero and as both switches are turned off the voltage across S2 and thus Cs2 will rise. When in the next stage S2 is turned on again the energy stored in Cs2 will be dissipated in S2 causing high discharge current and high switching loss and stress in S2.

In the next stage shown in FIG. 4(*e*) S2 is ON while S1 is OFF and the inductor current becomes negative. As both switches once more go to OFF, shown in FIG. 4(*f*), the anti-parallel diode of S1 starts to conduct clamping the voltage across S1 to near zero (FIG. 4(*g*)). Again, as with S2, if the duty cycle is not too small S1 will be switched on again before the inductor current decays to zero and so will be switched on while still clamped to near zero voltage, with the advantages discussed above. If the duty cycle is too small, however, the inductor current will decay to zero before S1 is switched on again causing the voltage across S1 and Cs1 to rise. When S1 is finally turned on again the energy stored in Cs1 is dissipated in S1 as discussed above with regard to S2 and with the same problems. This possibility is shown in FIG. 4(*h*).

Thus if dimming control by variation of duty cycle is provided, soft switching is possible provided that the inductor current is continuous. However if the duty cycle is reduced too far then the inductor current may at points in the cycle decay to zero and non-zero-voltage switching takes place with its attendant disadvantages of higher EMI emission and higher switching stress.

As an alternative to dimming control by duty cycle variation, it is also known to provide dimming control by varying the switching frequency. If the switching frequency is increased, the inductor impedance is increased and thus the inductor current is reduced. This allows the output of a fluorescent lamp to be controlled by varying the switching frequency and FIG. 5 shows the power of a 4-ft 40 W fluorescent lamp plotted against switching frequency. It can be seen that the lamp power, and therefore the intensity of the emitted light, decreases with increasing switching frequency.

Dimming control by varying switching frequency has its own disadvantages however. These include the following points:

1. If the inverter bridge is not soft-switched the switching loss of the inverter will be increased leading to reduced efficiency.
2. In order to achieve dimming control at low lamp power operation, the switching frequency range has to be very wide (eg from 25 kHz to 65 kHz) and in practice the frequency range of the magnetic cores, the gate drive circuits and electronic control circuit may all act to limit the range of dimming control.
3. Soft-switching is not easy to achieve over the entire switching frequency range. In particular, at light loads soft-switching cannot be achieved and the switching stress is large. The switching transients due to hard-switching are a major source of EMI emissions.
4. The power range of the dimming control is limited if the switching frequency range is small. A typical range of dimming control is from 100% load to 25% load.

SUMMARY OF THE INVENTION

Viewed from one broad aspect the present invention provides apparatus for controlling the power output of a fluorescent lamp comprising, an electronic ballast for driving said fluorescent lamp, power supply means for providing DC power input to said electronic ballast, and means for varying the voltage of said DC power input to said electronic ballast.

In one embodiment the power supply may comprise an AC power input followed by an AC-DC converter capable of providing a (i) power factor correction and (ii) variable DC output. Such converters may comprise a diode bridge followed by one of (a) a flyback converter, (b) a Cuk converter, (c) a SEPIC converter, (d) a Shepherd-Taylor converter, and (e) a boost converter. Preferably this front end converter uses soft-switching.

Alternatively in another embodiment the power supply may comprise a DC power input followed by a DC—DC converter capable of providing a variable DC output. The converter may be a step-down or a step-up/step-down converter.

Preferably the electronic ballast comprises a half-bridge series resonant inverter. The ballast preferably comprises two switches soft-switched at a constant frequency slightly higher than the resonant frequency of an inductor-capacitor tank of the ballast. The switches are preferably switched at a constant duty-cycle, preferably as close as possible to 0.5 while providing a short deadtime therebetween to prevent shoot-through.

Viewed from another broad aspect the present invention provides a method for controlling the power output of a fluorescent lamp driven by means of an electronic ballast in the form of a half-bridge resonant inverter, comprising operating said ballast at a constant duty cycle and a constant frequency and providing a variable DC power input to said ballast.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Figure 1:
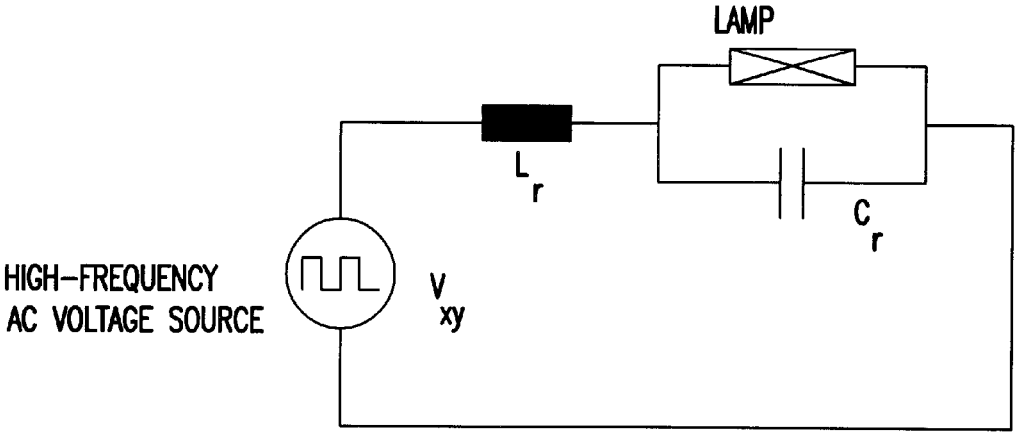
FIG.1 PRIOR ART
FIG. 1 is a simplified schematic drawing of a series-resonant inverter based electronic ballast of the prior art.
Figure 2:
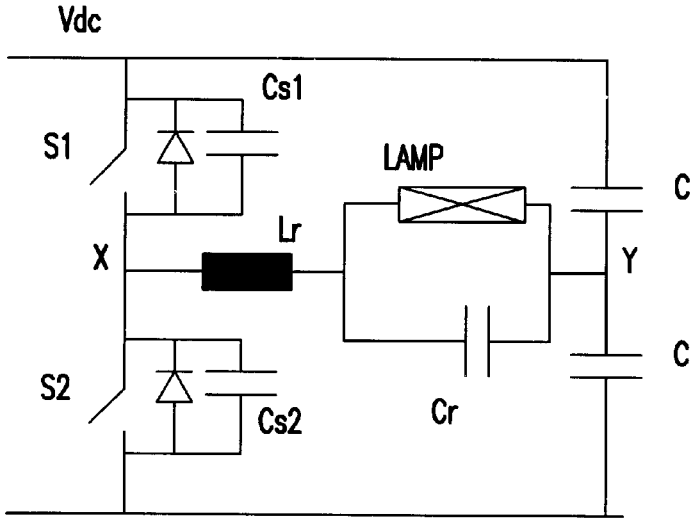
FIG.2 PRIOR ART
FIG. 2 is a schematic diagram of a half-bridge series resonant inverter based electronic ballast of the prior art.
Figure 3:
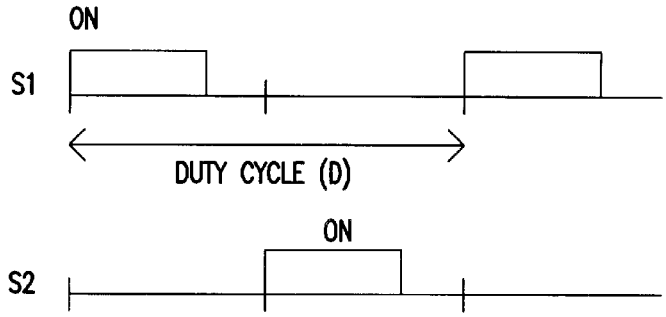
FIG. 3 illustrates typical waveforms of gating signals for the switches of the ballast of FIG. 2, FIGS. 4(*a*)–(*h*) illustrate successive operational stages of the ballast of FIG. 2 with the main current path of each stage being highlighted in bold.
Figure 4A:
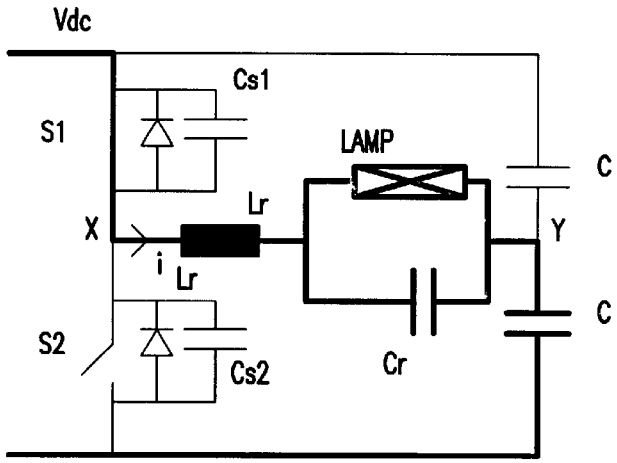
Figure 4B:
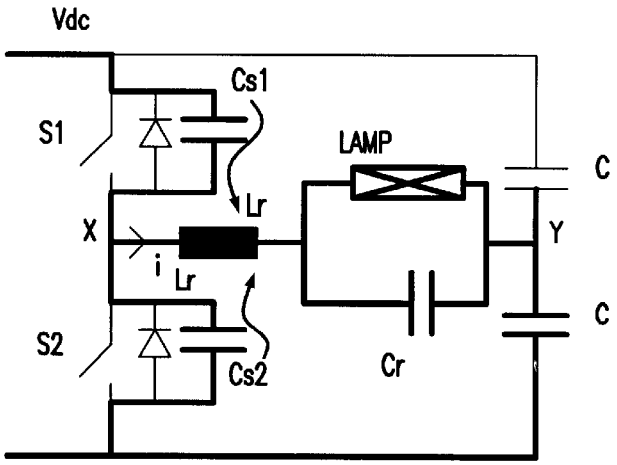
Figure 4C:
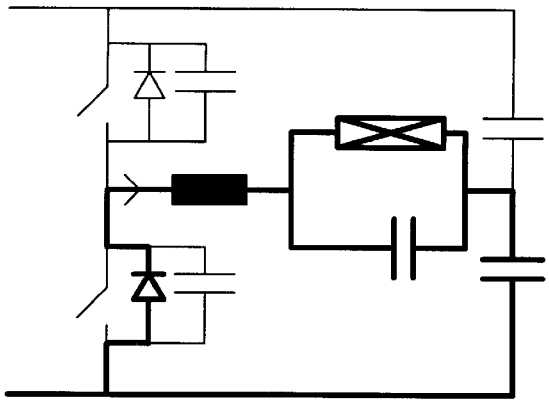
Figure 4D:
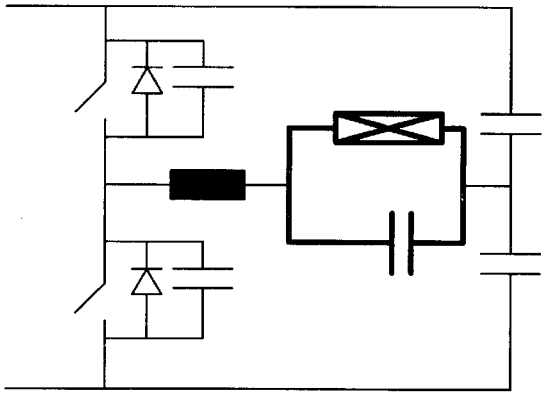
Figure 4E:
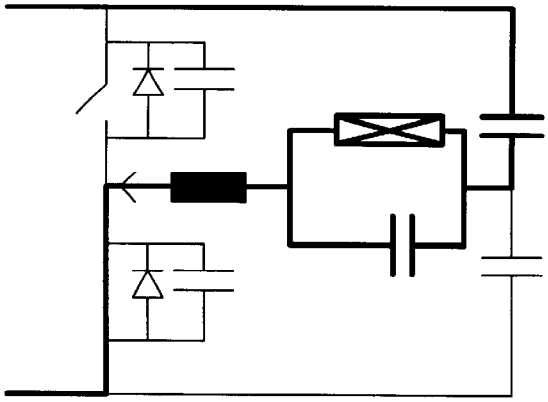
Figure 4F:
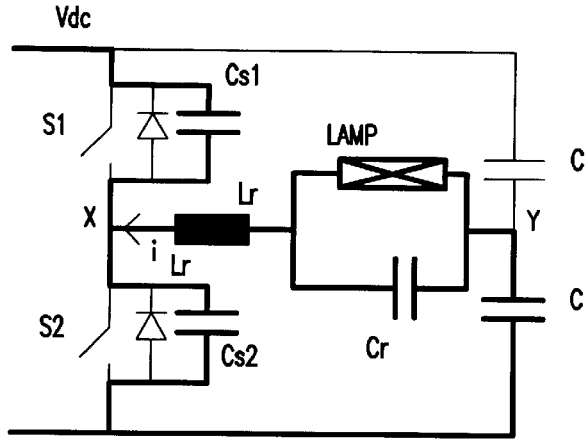
Figure 4G:
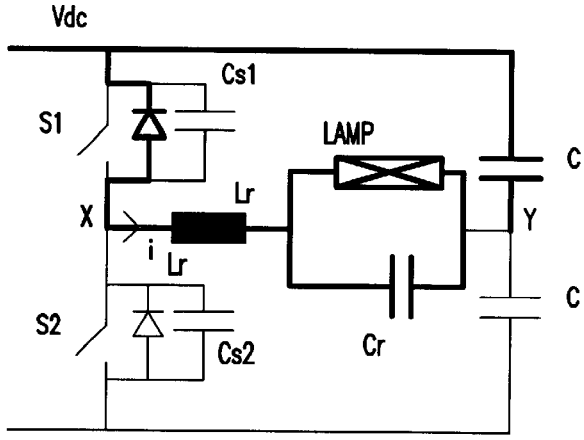
Figure 4H:
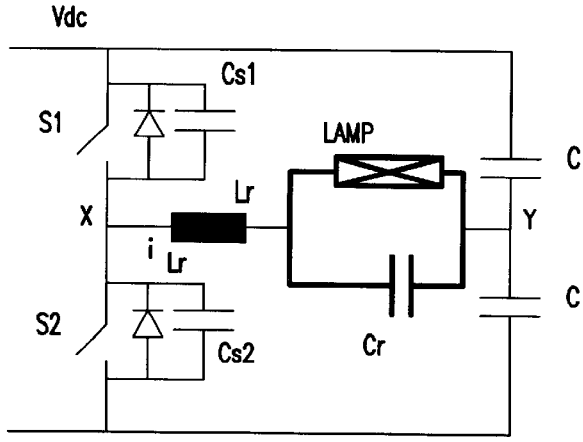
Figure 5:
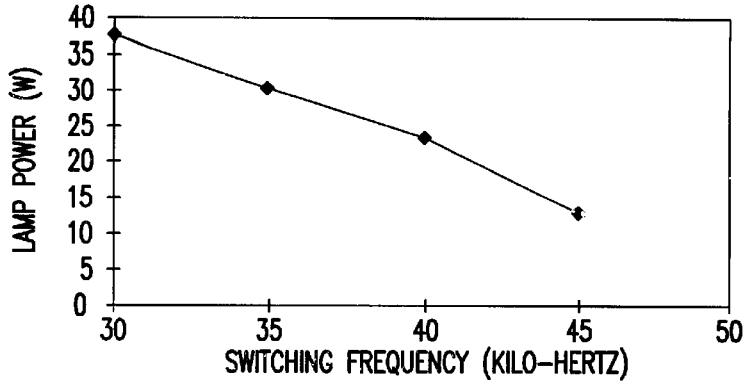
FIG. 5 is a plot showing expected lamp power against switching frequency in an alternative prior art method of dimming control.
Figure 6:
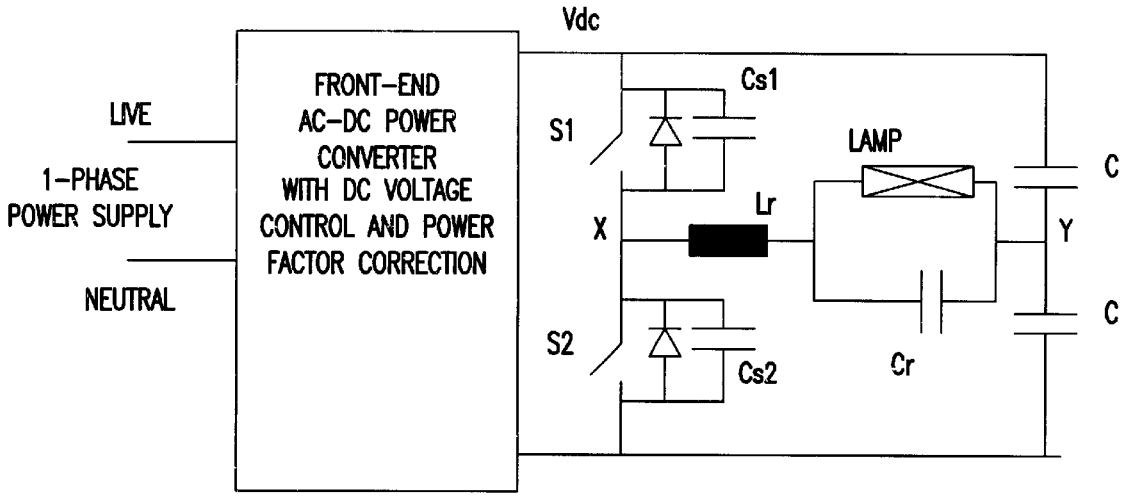
FIG. 6 is a schematic diagram of an electronic ballast provided with dimming control in accordance with a first embodiment of this invention.
Figure 7:
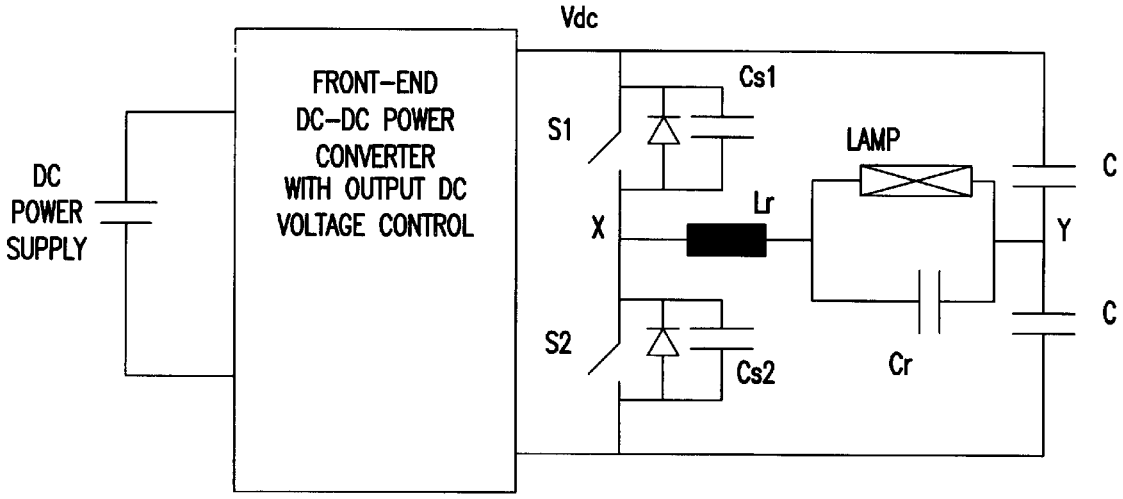
FIG. 7 is a view corresponding to FIG. 6 of a second embodiment of the invention.
Figure 8:
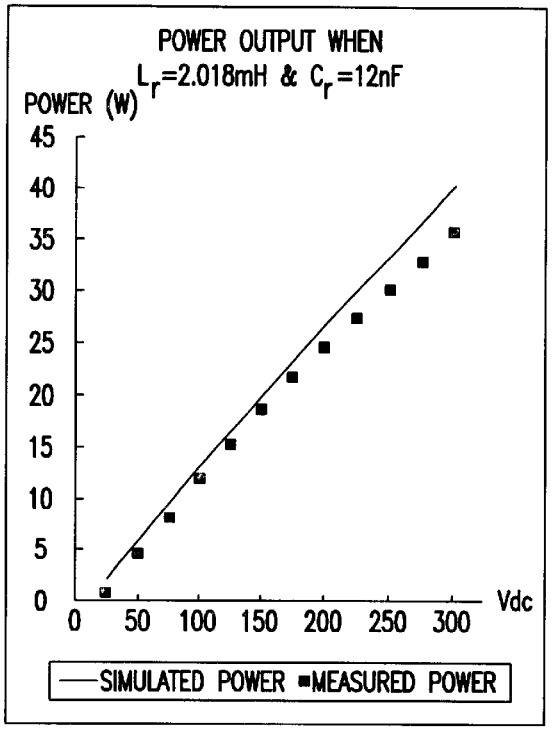
FIG. 8 is a plot showing lamp power output as a function of converter voltage, FIG. 9 schematically illustrates one form of AC-DC converter that may be used in the present invention, FIGS. 10(*a*) and (*b*) illustrate alternate topologies for the converter of FIG. 9, FIG. 11 schematically illustrates another form of AC-DC converter that may be used in the present invention.

In the present invention, dimming control is achieved by the use of a variable converter DC voltage as the means to provide a smooth and desirable dimming control for a fluorescent lamp system. Referring to FIG. 6 it will be seen that a power converter is inserted between the input power supply and the half-bridge circuit with the power converter being able to produce a variable $V_{DC}$ output to the half-bridge circuit. FIG. 6 assumes that the power supply is AC and so the converter is an AC-DC converter, but as shown in FIG. 7 the same principle can apply when the input power supply is DC by providing a front-end DC—DC converter with control of the output DC voltage.

In the present invention the output DC voltage $V_{DC}$ of the front-end converter is controlled in order to control the lamp power. A constant duty-cycle (nearly 0.5) is used for the switching of the half-bridge inverter in order to ensure a wide power range of continuous inductor current operation and thus soft-switching operation. This has the further advantage of making switching control simple. A constant switching frequency is used in the converter so that the resonant L-C circuit can be optimised for any given type of lamp.

As shown in FIG. 6 if the input power supply is an AC supply, the front end converter must naturally be an AC-Dc converter. Examples of suitable AC-DC converters include (a) a diode bridge followed by a flyback converter, (b) a diode bridge followed by a Cuk converter, (c) a diode bridge followed by a Sepic converter, (d) a diode bridge followed by a Shepherd-Taylor converter, and (e) a diode bridge followed by a boost converter. These five AC-DC converters can provide input power factor correction in order to reduce voltage harmonics and current harmonics in the AC power supply. In addition, to further reduce EMI emissions, soft-switching is preferably incorporated into the front-end converter. This may be achieved by adding an auxiliary circuit to the front-end converter A significant advantage of controlling $V_{DC}$ to provide dimming control is that lamp power decreases smoothly and almost linearly with decreasing $V_{DC}$. This can be seen from FIG. 7 which shows simulated and measured lamp power values as a function of $V_{DC}$ for a 4-ft 40 W lamp under a constant duty cycle and constant switching frequency. From FIG. 7 it can be seen that there is a substantially linear relationship between lamp power and $V_{DC}$ which makes dimming control very easy and convenient.

Figure 9:
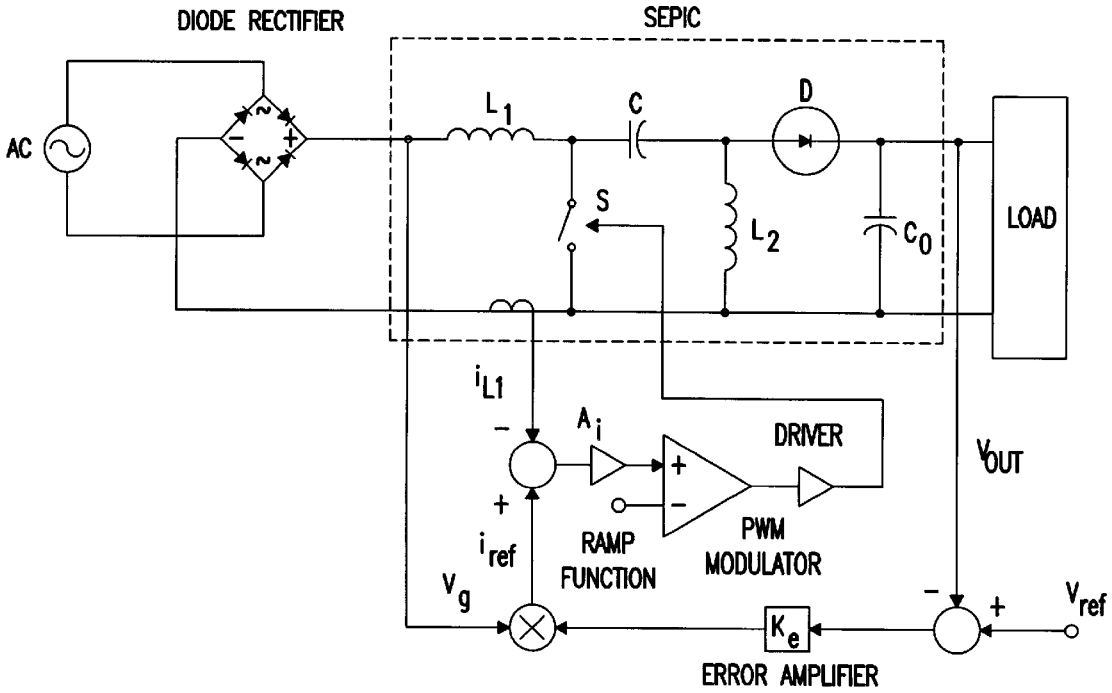

FIG. 9 illustrates an embodiment comprising a front-end SEPIC (single-ended-primary-inductance-converter). In consideration of this embodiment the half-bridge resonant electronic ballast can be considered as the load. The SEPIC comprises one controlled switch S and one uncontrolled switch D. The controlled switch S can be a MOSFET, BJT, IGBT or the like and its conduction state is determined by the gate signal $v_{gate}$. In order to avoid needing to use an input line filter the converter is operated in continuous conduction mode where two circuit topologies are switched alternately in one cycle. These topologies are shown in FIG. 10.

Figure 10A:
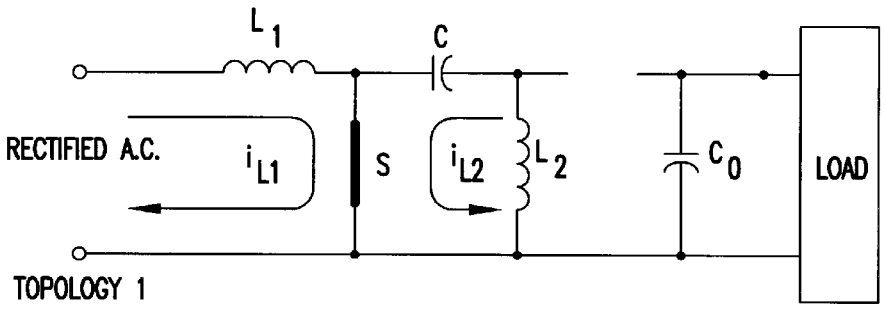
Figure 10B:
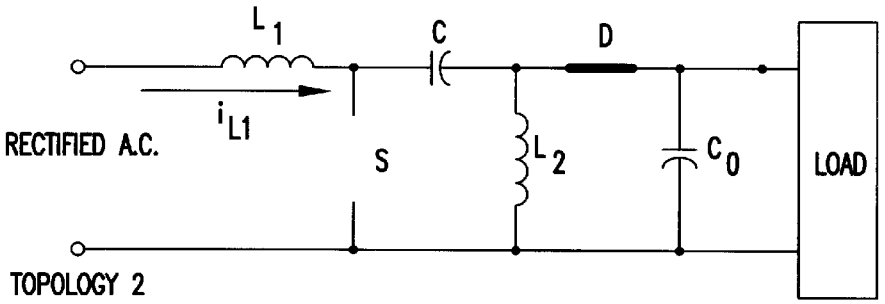

In the first topology—shown in FIG. 10(*a*)—S is on while D is reverse biased and the currents in the inductors $L_1$ and $L_2$ ($i_{L1}$ and $i_{L2}$) increase. When $i_{L1}$ reaches a programmed threshold value S will be switched off. This leads to the second topology shown in FIG. 10(*b*) where S is off and D conducts. The output capacitor $C_O$ is then charged by the sum of the currents in $L_1$ and $L_2$.

The input current of the SEPIC is controlled to follow the full-rectified waveform of the sinusoidal input voltage $v_g$ by pulse-width modulation (PWM) control. In this technique the reference signal $i_{ref}$ for the current-shaping feedback loop is proportional to $v_g$. The input current is sensed and compared to the reference signal and an identified error signal is amplified by a current loop amplifier $A_i$ the output of which is compared to a ramp function. In this way the duty ratio of S may be adjusted in order to minimize the error between the reference current and the sensed line current. Thus, the output voltage is in fact controlled by adjusting the reference current $i_{ref}$. This requires a multiplier circuit in the voltage feedback loop, and an error amplifier $K_e$, such as a proportional-plus-integral controller, is used to process the error between the output voltage $v_{out}$ and a reference voltage $v_{ref}$ to give a necessary signal to one of the multiplier inputs so that $v_{out}$ will follow the desired magnitude of $v_{ref}$.

Figure 11:
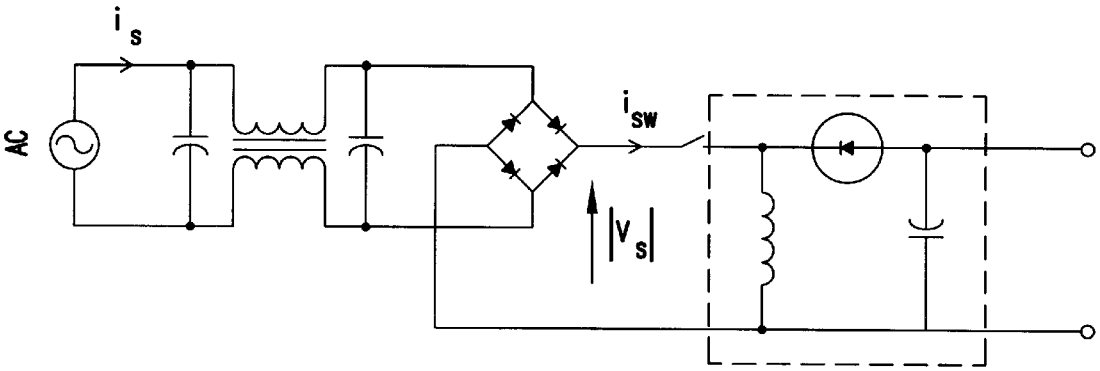
Figure 12:
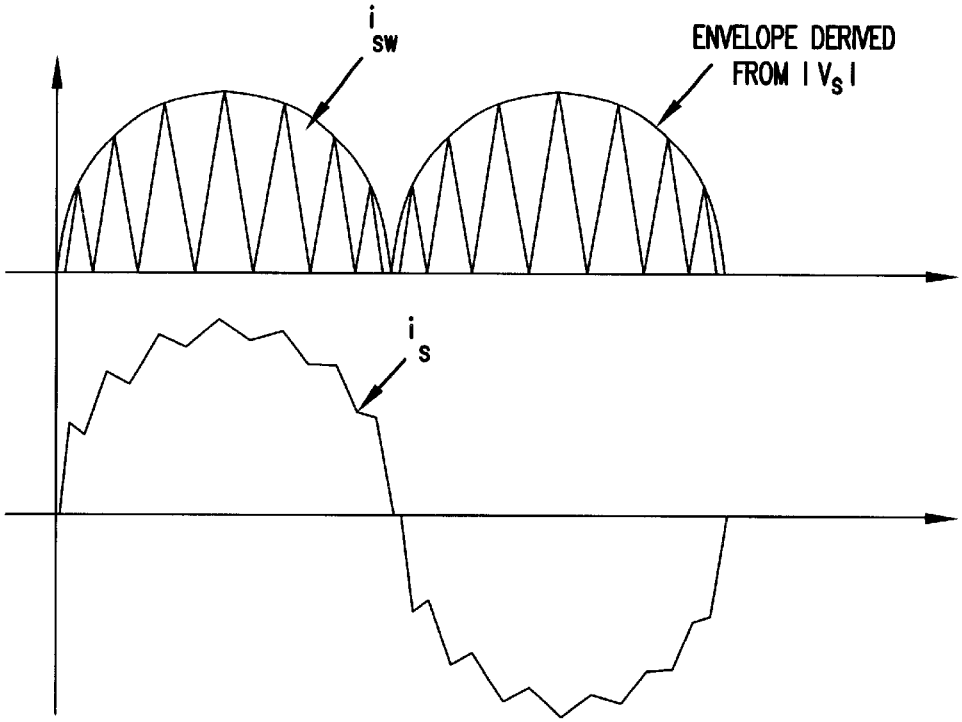
FIG. 12 shows typical waveforms for the switch current and the input phase current in the converter of FIG. 11.
Figure 13:
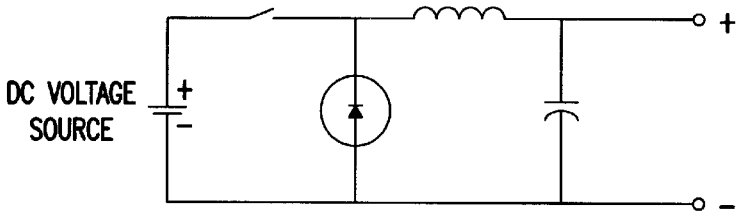
FIG. 13 shows one form of DC—DC converter that may be used in another embodiment of the present invention.
Figure 14:
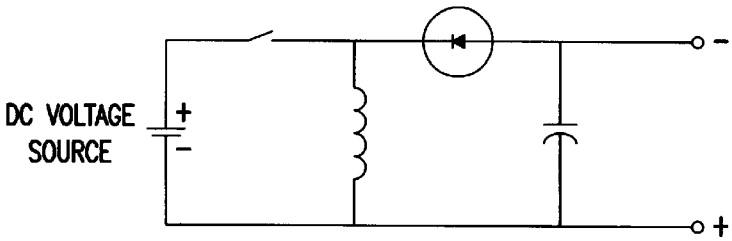
FIG. 14 shows an alternate form of DC—DC converter.

FIG. 11 illustrates an alternative embodiment with an AC-DC front-end converter. In this embodiment the front-end converter comprises an AC-DC flyback converter. The input voltage to the flyback converter (enclosed in the dashed box) is the rectified version of the AC input voltage $v_s$, and if the flyback converter is switched so that the flyback inductor current $i_L$ is discontinuous, the envelope of the current pulses will follow the shape of the rectified voltage waveform. The input L-C filter reduces the current ripple and thus the input phase current $i_s$ is sinusoidal as shown in FIG. 12. If the switching frequency is high, say 20 kHz to 100 kHz, the current ripple becomes negligible. In this embodiment the AC-DC converter shapes the current into a sinusoidal curve so as to achieve a unitary power factor (ie current is sinusoidal and in phase with the input voltage). The magnitude of the input AC voltage may be fixed by the mains supply (220V say) but the input current magnitude can be controlled and thus the output of the AC-DC converter may be controlled by controlling the magnitude of the input AC current.

Where the input power supply is DC the choice of the most suitable DC—DC converter depends on the voltage level of the input DC supply, and hence whether a step-up or a step-down converter is necessary. Examples of possible DC—DC front-end converters are shown in FIG. 13 and FIG. 14. FIG. 13 shows a possible step-down (buck) converter, while FIG. 14 shows a flyback converter that may be either a step-up or step-down converter.

Thus it will be seen that in its preferred forms the present invention provides a ballast comprising a front-end converter that can provide a variable DC voltage output. The front-end converter can be a power-factor-corrected AC-DC converter (preferably with soft-switching) if the input supply is AC, and a DC—DC converter if the input supply is DC. The DC output voltage of the front-end converter is fed to a soft-switched half-bridge inverter with an inductor-capacitor resonant circuit. The fluorescent lamp is connected across the resonant capacitor. The two switches in the half-bridge inverter are switched at a constant frequency slightly higher than the resonant frequency of the inductor-capacitor tank. The two inverter switches are switched in a complementary manner with a large constant duty cycle in order to achieve soft-switching in the half-bridge inverter over a wide power range.

To control the brightness of the lamp to provide a dimming control, the lamp power is simply controlled by varying the DC output voltage of the front-end converter. This allows the inverter bridge to operate under continuous inductor current mode regardless of the power output of the lamp, ie from nominal DC voltage for full lamp power down to very low DC voltage for low lamp power, thereby reducing EMI emissions from the inverter bridge over a wide power range. Together with power-factor-corrected and soft-switched front-end AC-DC or DC—DC converter, the present invention allows the entire ballast system to have low conducted and radiated EMI emission, low switching losses and stress, and thus high reliability. The present invention may also be applied to single or multi-lamp systems.

What is claimed is:

1. An apparatus for providing dimming control of the power output of a fluorescent lamp comprising, an electronic ballast for driving said fluorescent lamp comprising two switches soft-switched at a constant frequency, power supply means comprising an AC power-supply, and a power factor corrected AC-DC converter capable of producing a variable DC output variable between 20 V and 300 V provided between said power supply means and said electronic ballast, wherein dimming control is provided by varying the DC voltage input to said ballast.

2. The apparatus as claimed in claim 1 wherein said ballast comprises a half-bridge series resonant inverter.

3. The apparatus as claimed in claim 1 wherein said AC-DC converter comprises a diode bridge followed by a converter, wherein the converter is (a) a flyback converter, (b) a Cuk converter, (c) a Sepic converter, (d) a Shepherd-Taylor converter, or (e) a boost converter.

4. The apparatus as claimed in claim 3 wherein said converter uses soft-switching.

5. The apparatus as claimed in claim 1 wherein said electronic ballast comprises said two switches soft-switched at a constant frequency slightly higher than the resonant frequency of an inductor-capacitor tank of said ballast.

6. The apparatus as claimed in claim 5 wherein said two switches are switched at a constant duty-cycle.

7. The apparatus as claimed in claim 6, wherein the duty cycle is slightly below 0.5.

8. An apparatus for providing dimming control of the power output of a fluorescent lamp comprising, an electronic ballast for driving said fluorescent lamp comprising two switches soft-switched at a constant frequency, power supply means comprising a DC power supply, and a DC—DC converter capable of producing a DC output variable between 20 V and 300 V provided between said power supply means and said electronic ballast, wherein dimming control is provided by varying the DC voltage input to said ballast.

9. The apparatus as claimed in claim 8 wherein said DC—DC converter is a step-down converter.

10. The apparatus as claimed in claim 8 wherein said DC—DC converter is a step-up converter.

11. A method for providing dimming control of the power output of a fluorescent lamp driven by means of an electronic ballast in the form of a half-bridge resonant inverter comprising operating two switches;

operating said ballast at a constant duty-cycle and at a constant frequency of said two switches;

soft-switching said two switches; and providing a dimming control by varying a DC power input to said ballast between 20 V and 300 V.

12. An apparatus for providing dimming control of the power output of a fluorescent lamp comprising, an electronic ballast for driving said fluorescent lamp at a constant frequency, power supply means for providing a DC power input to said electronic ballast, and means for varying the voltage of said DC power input to said electronic ballast, said means for varying the voltage of said DC power input being capable of producing a DC output variable between 20 V and 300 V provided between said power supply means and said electronic ballast, wherein said electronic ballast comprises two switches soft-switched at a constant frequency slightly higher than the resonant frequency of an inductor-capacitor tank of said ballast.

* * * * *